United States Patent [19]

Polidori

[11] 4,415,222

[45] Nov. 15, 1983

[54] ELECTRICAL CONNECTOR

[76] Inventor: Mario Polidori, 1840 W. River Dr., Pennsauken, N.J. 08110

[21] Appl. No.: 225,833

[22] Filed: Jan. 19, 1981

[51] Int. Cl.[3] ..... H01R 11/10

[52] U.S. Cl. ..... 339/270 R

[58] Field of Search ..... 339/247, 270, 273 R, 339/273 F, 263 R, 263 E, 263 L, 273; 411/1, 2

[56] References Cited

U.S. PATENT DOCUMENTS

| | | | |
|---|---|---|---|
| 1,707,933 | 4/1929 | Gibbons | 339/263 R |
| 1,801,277 | 4/1931 | Kelley | 339/247 |
| 2,399,957 | 5/1946 | Tinnerman | 339/263 R |
| 2,957,157 | 10/1960 | Carter | 339/270 R |
| 2,997,522 | 8/1961 | Schneider | 339/247 |
| 3,065,449 | 11/1962 | Matthysse et al. | 339/273 R |
| 3,132,914 | 5/1964 | Wengen | 339/264 L |
| 3,174,385 | 3/1965 | Hallowell, Jr. | 411/2 |
| 3,544,956 | 12/1970 | Bricker, Jr. | 339/264 L |
| 3,811,105 | 5/1974 | Gerhard | 339/273 F |
| 4,027,939 | 6/1977 | White | 339/270 R |
| 4,114,977 | 9/1978 | Polidori | 339/270 R |

FOREIGN PATENT DOCUMENTS

| | | | |
|---|---|---|---|
| 292214 | 1/1954 | Switzerland | 339/273 R |
| 704091 | 2/1954 | United Kingdom | 339/270 R |

*Primary Examiner*—Joseph H. McGlynn
*Attorney, Agent, or Firm*—Duffield & Lehrer

[57] ABSTRACT

An electrical connector is disclosed which is particularly adapted to electrically and mechanically connect a transmission conductor to a distribution conductor. The connector includes a C-shaped body having a curved top wall adapted to fit over a transmission conductor. A screw-operated wedge is carried by the bottom of the C-shaped body and includes an elongated recess in the top for supporting the distribution conductor. A conductor interface has a handle or gripping means thereon which allows the same to be easily placed within the connector body between the connectors. The screw positively moves the wedge both in and out so that the clamping action of the connector can be tightened or loosened as desired. A frangible nut prevents overtightening of the screw and a locking washer includes tabs which may be bent into place to prevent the screw from accidentally turning.

14 Claims, 6 Drawing Figures

ELECTRICAL CONNECTOR

BACKGROUND OF THE INVENTION

The present invention is directed toward an electrical connector and more particularly toward an electrical connector which is adapted to electrically and mechanically connect an electrical transmission conductor to a distribution conductor.

A number of connector assemblies have been proposed in the past for connecting distribution conductors or tap lines to overhead electrical transmission conductors. One such assembly is shown, for example, in U.S. Pat. No. 4,027,939. This patent shows a connector comprised generally of a C-shaped housing wherein the transmission conductor is intended to be positioned in the upper part of the housing and the tap conductor in the lower part thereof. A tapered wedge block is drawn into the housing by a screw member which pushes the conductors away from each other and against the upper and lower walls of the C-shaped housing.

U.S. Pat. No. 4,027,939 has some significant disadvantages. Most notably, there is no way of conveniently removing the wedge block if it is ever desired to disconnect the conductors. Furthermore, assembly of the connector with the conductors requires the use of two hands and accordingly there may be certain applications where the connector cannot be conveniently used. connector which includes a feature allowing the conductor-engaging members to be withdrawn from the conductor so that the connection can be disconnected. This connector, however, also cannot be installed with one hand and is substantially more complex and more expensive to manufacture in that it requires two different screw means for separately securing the transmission conductor and the distribution conductor. In addition to the foregoing, neither this patent nor any other patent known to Applicant provide a means for indicating when sufficient torque has been applied to the screw means for a secure connection.

SUMMARY OF THE INVENTION

The present invention is believed to overcome all of the foregoing and other problems with the prior art devices known to Applicant. The electrical connector of the present invention which is particularly adapted to electrically and mechanically connect a transmission conductor to a distribution conductor includes a C-shaped body having a curved top wall adapted to fit over a transmission conductor. A screw-operated wedge is carried by the bottom of the C-shaped body and includes an elongated recess in the top for supporting the distribution conductor. A conductor interface has a handle or gripping means thereon which allows the same to be easily placed within the connector body between the connectors. The screw positively moves the wedge both in and out so that the clamping action of the connector can be tightened or loosened as desired. A frangible nut prevents overtightening of the screw and a locking washer includes tabs which may be bent into place to prevent the screw from accidentally turning.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
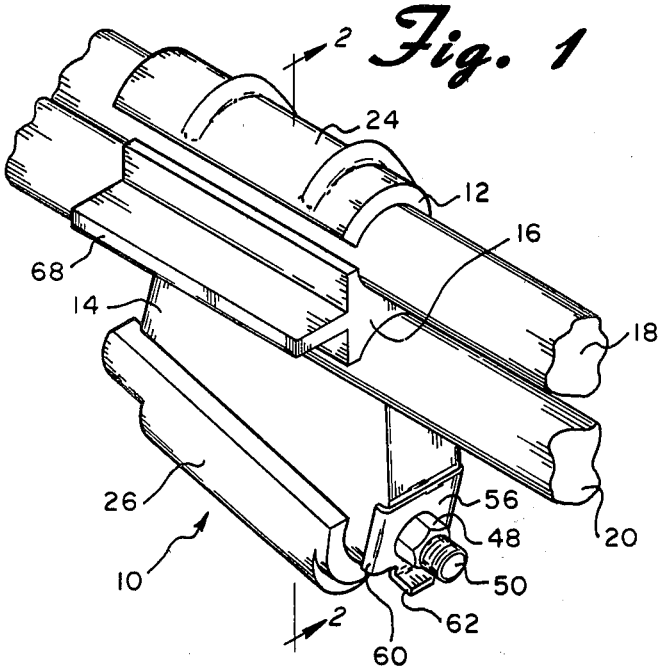
FIG. 1 is a perspective view of an electrical connector constructed in accordance with the principles of the present invention and showing the same in use.

Referring now to the drawings in detail wherein like reference numerals have been used throughout the various figures to designate like elements, there is shown in FIG. 1 an electrical connector constructed in accordance with the principles of the present invention and designated generally as 10. Connector 10 is comprised essentially of three main parts: a substantially C-shaped body member 12, a movable wedge 14 and a removable conductor interface insert 16. FIG. 1 shows the connector electrically and mechanically connecting a transmission conductor 18 to a distribution conductor 20; only a portion of the conductors 18 and 20 being shown.

Figure 3:
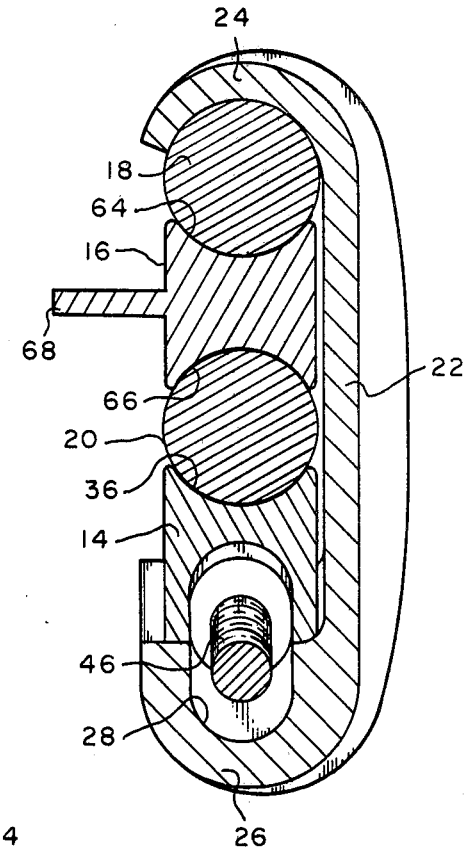
FIG. 3 is a cross-sectional view taken through the lines 3—3 of FIG. 2.

As shown more clearly in FIG. 3, the body member 12 has a substantially flat rear wall 22, a curved top wall 24 and a curved bottom wall 26. The transmission conductor 18 fits within the curve of the top wall 24. More correctly, the top wall 24 of the connector 10 is adapted to fit partially around the transmission conductor 18.

Figure 4:
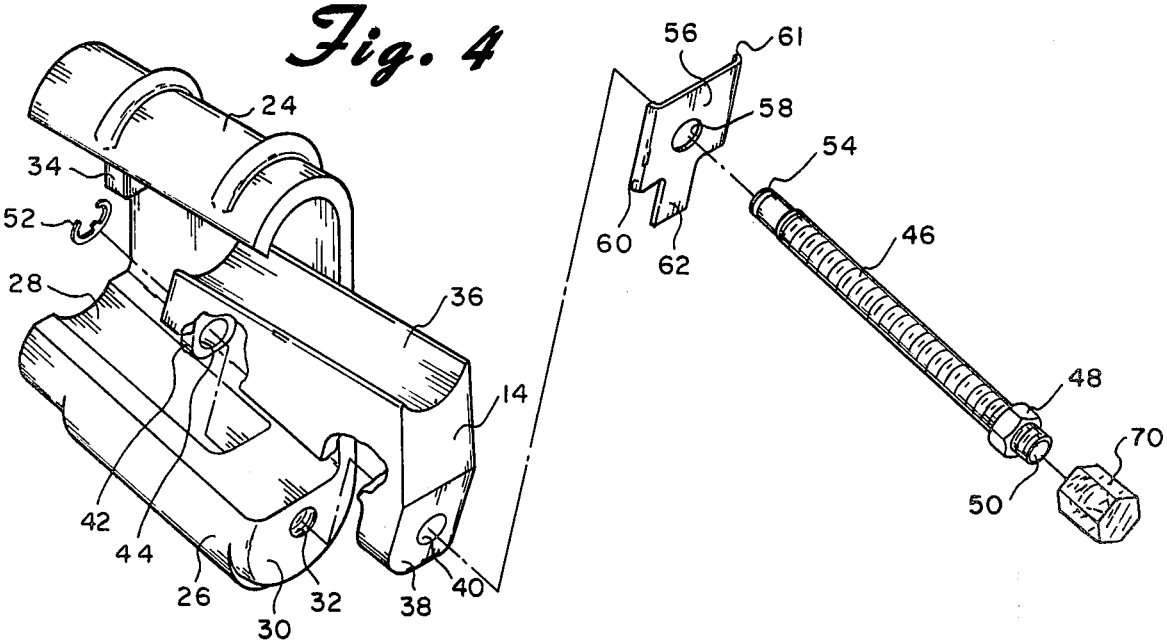
FIG. 4 is an exploded view showing the manner in which several components of the connector are assembled.

The major portion of the length of the interior of the bottom wall 26 is also curved as shown most clearly in FIG. 4 at 28. However, the forward end 30 of the bottom portion is substantially solid. An internally threaded bore 32 passes through the substantially solid portion 30 from the front of the connector 10 into the channel or curved portion 28 (see FIG. 2). For the reasons which will become clearer hereinafter, a stop member 34 is securely fixed to the far end of the rear wall 22 and extends into the interior of the C-shaped body member 12.

Wedge 14 includes an elongated upper surface in the form of an elongated recess 36. As shown in FIGS. 1 and 3, the recess 36 is adapted to cooperate with the bottom surface of the distribution conductor 20.

Extending downwardly from the forward end of the wedge 14 is first tab 38 having an aperture 40 passing there through. A second tab 42 having an aperture 44 passing there through extends downwardly from the rearward end of the wedge 14. The diameter of the apertures 40 and 44 are slightly larger than the diameter of the bore 32. Furthermore, the outer configuration of the tab 42 is substantially complementary to the cross-sectional shape of the interior curved portion 28 of the bottom wall 26 so that the tab 42 in cooperation with the curved portion 28 functions as a guide means in guiding the wedge 14 in its movement toward the interior of the C-shaped body member 10 and in the reverse direction away from the interior thereof.

An elongated screw 46 has an external thread thereon which is complementary to the thread of the threaded bore 32. A nut 48 is fixedly secured to the screw 46 adjacent one end thereof to function as a head for the screw. A short threaded portion 50 of the screw, however, extends beyond the nut 48.

Figure 2:
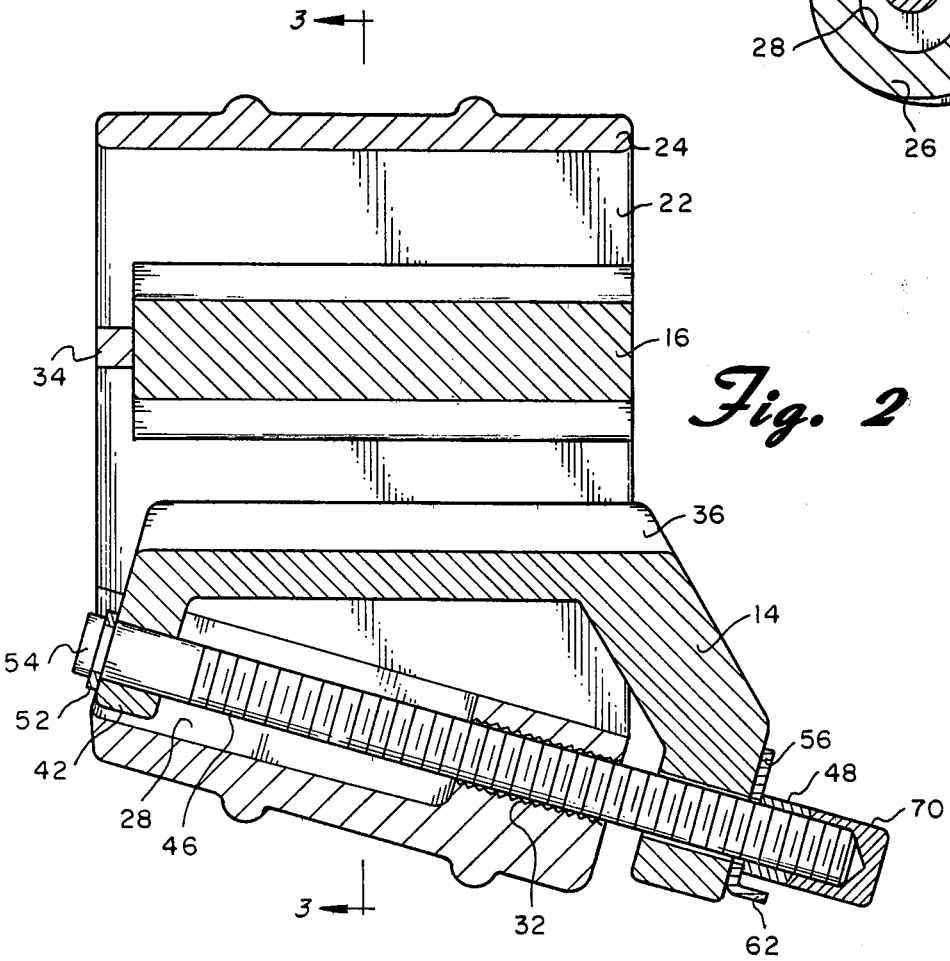
FIG. 2 is a cross-sectional view taken through the lines 2—2 of FIG. 1, the electrical conductors being removed for clarity.

As shown most clearly in FIGS. 2 and 4, screw 46 is adapted to freely pass through the aperture 40 and is then threaded into the bore 32. The screw 46 continues on through the aperture 44. An enlarged member in the form of a lock washer 52 or the like is secured to the free end 54 of the screw 46. It should be readily apparent from viewing FIG. 2 that when screw 46 is rotated in a clockwise direction it is threaded into the bore 32 (from right to left as viewed in FIG. 2) and the nut or head 48 pushes the front wall of the tab 38 and thus the entire wedge 14 into the interior of the C-shaped body 12. And because of the shape of the wedge 14 and the angle of the bore 32, as the wedge is moved into the interior of the body 12, the upper surface 36 of the wedge 14 moves upwardly toward the top wall 24. Similarly, when the screw 46 is rotated in a counterclockwise direction, it moves to the right as viewed in FIG. 2 and the lock washer 52 abuts the end face of the tab 42 pushing the same to the right thereby withdrawing the wedge from the interior of the C-shaped body 12. As this occurs, the upper surface 36 of the wedge 14 moves downwardly away from the top wall 24.

A means is also provided for preventing rotation of the screw 46 when it is set at its desired position. This rotation preventing means is comprised of a washer-like member 56. The rotation-preventing device 56 is comprised of a substantially rectangular-shaped piece of sheet metal having an aperture 58 passing there through adjacent the center thereof which aperture is large enough for the screw 46 to pass freely through. The side edges 60 and 61 are bent forwardly so as to fit around the sides of the first tab 38. This prevents the device 56 from rotating. Once the screw 46 has been turned so that the wedge is in its desired position, tab 62 at the lower end of the rotation-preventing device 56 is bent toward the nut or head 48 and is pressed against one of the flat surfaces thereof thereby preventing rotation of the head 48 and thus the screw 46.

Located between the transmission conductor 18 and a distribution conductor 20 is the interface insert 16. Insert 16 is elongated in shape having a length substantially the same as the C-shaped body 12. A recess 64 is formed in the upper surface of the insert 16 and a similarly shaped recess 66 is formed in the lower surface thereof. As shown most clearly in FIGS. 1 and 3, the recess 64 contacts the lower surface of the transmission conductor 18 and the recess 66 cooperates with the upper surface of the distribution conductor 20. A handle or gripping means 68 extends from the insert 16 to the exterior of the C-shaped body member 12. Th gripping means 68 can be easily and conveniently held by a pair of pliers so that the same can be easily moved into or out of place when desired.

Figure 6:
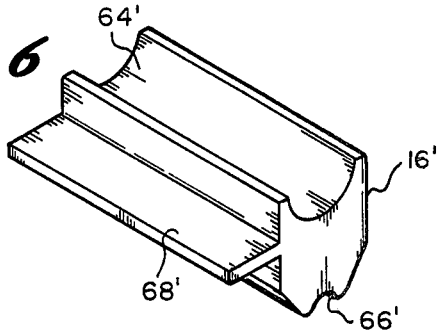
FIG. 6 is a perspective view of a modified form of a conductor interface insert useful with the present invention.
Figure 5:
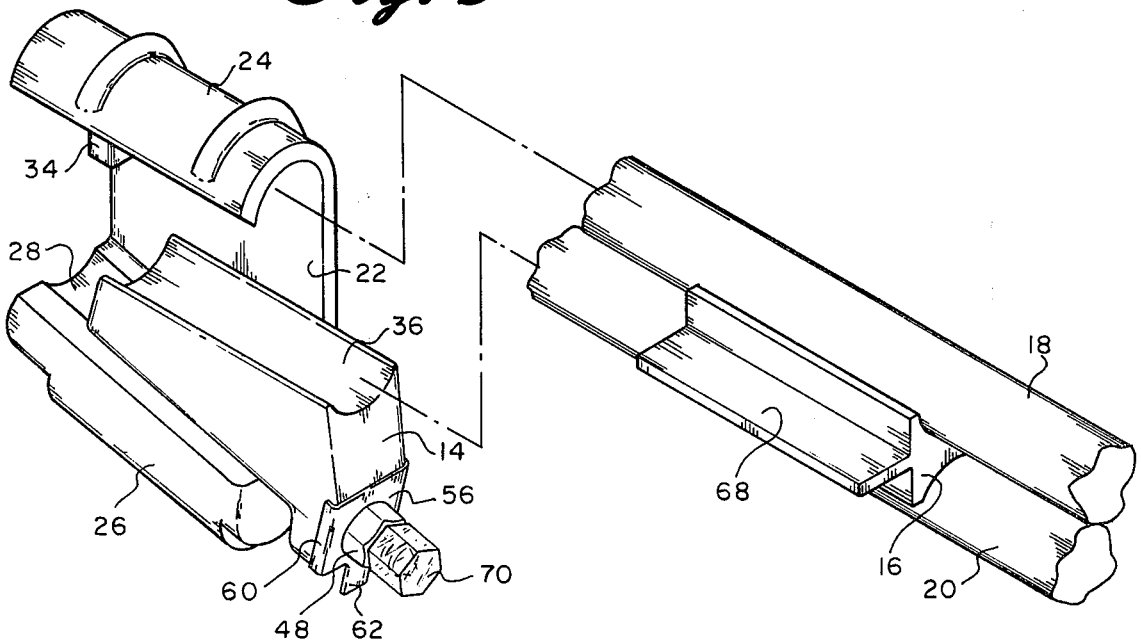
FIG. 5 is a perspective view similar to FIG. 1 but showing the manner in which the connector of the present invention is utilized to secure conductors.

The transmission and distribution conductors shown in the figures are of substantially the same diameter. Accordingly, the insert 16 has recesses 64 and 66 formed in the upper and lower surfaces thereof as explained above which have substantially the same configuration. In some applications, however, it may be desirable to connect a distribution conductor of smaller diameter with a larger diameter transmission conductor. For this reason, one or more additional interface inserts such as insert 16' may be provided as shown in FIG. 6. Insert 16' is substantially identical to insert 16 except that the recess 66' in the lower surface thereof has a substantially smaller radius of curvature than the recess 64' in the upper surface thereof. Various different inserts could be provided having various different size recesses in the upper and lower surfaces thereof. It should also be readily apparent that the inserts are invertible so that the insert 16', for example, shown in FIG. 6 could be utilized with a transmission conductor of relatively small diameter and a distribution conductor of a somewhat larger diameter.

The electrical connector 10 is used in the following manner. The device is first assembled without the insert 16 in place and the screw 46 is turned so that the wedge 14 is substantially withdrawn from the center of the C-shaped body 12. The connector is then suspended from a transmission conductor by placing the top wall 24 around the conductor. A distribution conductor is then laid across the top surface 36 of the wedge 14. An insert 16 is then positioned between the transmission and distribution conductors outside of the C-shaped member 12 and to the right thereof as viewed in the figures. The insert 16 is then moved to the left toward the interior and into the interior of the C-shaped body member 12 guided by the conductors. The insert 16 will stop at its proper position when the leading edge thereof hits the stop member 34.

With the insert 16 in place, the screw 46 is rotated and the wedge 14 is moved into the interior of the C-shaped body 12. As the wedge is moved into the interior of the body member 12, it also moves upwardly forcing recess 36 into intimate contact with the distribution conductor which in turn is forced against the lower surface 66 of the insert 16. At the same time, the upper surface 64 of the insert 16 contacts the transmission conductor 18 which in turn is forced into contact with the inner surface of the top wall 24 of the connector. When the wedge 14 is in its proper position and sufficient pressure is placed on the conductors so as to provide a proper connection, tab 62 is bent against the nut 48 to prevent further rotation of the screw 46. This prevents accidental or inadvertent loosening of the connector.

The present invention also provides a means for indicating when a predetermined amount of torque has been applied to the screw 46 to prevent excess pressure from being applied against the conductors which may cause damage thereto. This is in the form of a plastic nut 70 having an internally threaded bore therein. Nut 70 is threaded onto the end 50 of the screw 46 until it abuts the fixed nut or head 48. When it is desired to turn the screw 46, a wrench is applied to the nut 70. The composition of the nut 70 is selected so that when the proper amount of torque has been applied to the screw 46, any excess torque will cause the threads of the nut 70 to be stripped therefrom so that the nut 70 will then turn freely and can be removed and discarded. Nut 70 is an inexpensive frangible nut which can be discarded. It should be readily apparent to those skilled in the art that the amount of torque which can be applied to the nut 68 before the threads are stripped therefrom is also related to the number of turns which are engaged with the threads of the screw 46. Thus, the desired torque can also be adjusted by proper placement of the nut 48 so that more or less threads are present on the screw portion 50.

The present invention may be embodied in other specific forms without departing from the spirit or essential attributes thereof and accordingly, reference should be made to the appended claims rather than to the foregoing specification as indicating the scope of the invention.

I claim:

1. An electrical connector particularly adapted to electrically and mechanically connect an electrical transmission conductor to a distribution conductor comprising:

a substantially C-shaped body member having a substantially flat rear wall and curved top and bottom walls, said top wall being adapted to fit partially around a transmission conductor;

a wedge movably secured to the inside of said body member adjacent said bottom wall, said wedge including an elongated upper surface thereon parallel to said top wall;

screw means for moving said wedge parallel to said bottom wall, said screw means being capable of moving said wedge into the interior of said C-shaped body and in the reverse direction so as to withdraw the same therefrom, the upper surface of said wedge being moved toward said top wall when said wedge is moved toward the interior of said body and away from said top wall when said wedge is withdrawn therefrom;

an elongated recess formed in the upper surface of said wedge, said recess being adapted to cooperate with the bottom surface of a distribution conductor, and a removable elongated conductor interface insert within said C-shaped body, said insert having an upper surface adapted to contact the lower surface of said transmission conductor and having a lower surface adapted to cooperate with the upper surface of said distribution conductor.

2. The connector as claimed in claim 1 wherein said insert includes a gripping means extending therefrom outwardly from the rear wall of said body member.

3. The connector as claimed in claim 1 further including a stop means secured to and extending from the interior of said rear wall for limiting lateral movement of said insert.

4. The connector as claimed in claim 1 wherein the upper and lower surfaces of said insert have substantially identical configurations.

5. The connector as claimed in claim 1 wherein each of said upper and lower surfaces of said insert includes an elongated recess therein, the recess in said lower surface being smaller than the recess in said upper surface.

6. The connector as claimed in claim 1 wherein said screw means includes an elongated screw and further including means for preventing said screw from turning.

7. The connector as claimed in claim 1 wherein the connector includes unobstructed openings at the forward and rearward ends thereof above and below the insert whereby both the distribution conductor and the transmission conductor may pass entirely through the connector.

8. The connector as claimed in claim 1 wherein all of the surfaces of said connector which contact the transmission conductor and the distribution conductor are substantially smooth, toothless and continuous.

9. The connector as claimed in claim 1 wherein said wedge and said insert are each adapted to be moved laterally both forwardly and rearwardly independent of each other.

10. The connector as claimed in claim 1 wherein said screw means includes an internally threaded bore passing through the forward end of the bottom portion of said body member and an elongated screw adapted to be threaded therein, said wedge including a first tab extending downwardly from the forward end thereof and a second tab extending downwardly from the rearward end thereof, each of said tabs including an aperture therein which is large enough for said screw to pass freely there through.

11. The connector as claimed in claim 10 wherein said one end of said screw includes an enlarged head thereon which abuts the front wall of said first tab when said screw is passed through the aperture in said first tab, is threaded into said bore and is passed through said second tab whereby when said screw is turned in a first direction, said head pushes said first tab and hence said wedge into the interior of said C-shaped body.

12. The connector as claimed in claim 11 further including an enlarged member on the remote free end of said screw which abuts the rear wall of said second tab whereby when said screw is turned in the opposite direction, said enlarged member pushes against said second tab to thereby withdraw said wedge from the interior of said C-shaped body.

13. The connector as claimed in claim 1 further including means for indicating when a predetermined amount of torque has been applied to said screw means.

14. The connector as claimed in claim 13 wherein said screw means includes an elongated screw and wherein said torque indicating means includes a frangible nut adapted to be applied to one end of said screw.

* * * * *

UNITED STATES PATENT AND TRADEMARK OFFICE

CERTIFICATE OF CORRECTION

PATENT NO. : 4,415,222

DATED : November 15, 1983

INVENTOR(S) : Mario Polidori

It is certified that error appears in the above-identified patent and that said Letters Patent are hereby corrected as shown below:

Column 1, between lines 29 and 30, --Patent 3,544,956 is illustrative of an electrical-- has been inserted.

Column 3, line 58, "Th" has been changed to --The--.

Signed and Sealed this

Sixth Day of March 1984

[SEAL]

*Attest:*

GERALD J. MOSSINGHOFF

*Attesting Officer*

*Commissioner of Patents and Trademarks*